US006588156B2

(12) United States Patent
Mullet

(10) Patent No.: US 6,588,156 B2
(45) Date of Patent: Jul. 8, 2003

(54) SECTIONAL DOOR OPERATOR ALIGNMENT METHOD

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 32 days.

(21) Appl. No.: 10/001,488

(22) Filed: Oct. 23, 2001

(65) Prior Publication Data

US 2003/0075288 A1 Apr. 24, 2003

Related U.S. Application Data

(63) Continuation-in-part of application No. 09/499,488, filed on Feb. 7, 2000, now Pat. No. 6,325,134, which is a continuation-in-part of application No. 09/710,071, filed on Nov. 10, 2000.

(51) Int. Cl.[7] ..... E06B 3/00
(52) U.S. Cl. ..... 49/506; 160/189
(58) Field of Search ..... 160/189, 188, 160/201, 190, 405; 49/199, 200, 506

(56) References Cited

U.S. PATENT DOCUMENTS

| | | | | |
|---|---|---|---|---|
| 4,191,237 A | | 3/1980 | Voege | 160/188 |
| 4,472,910 A | | 9/1984 | Iha | 49/139 |
| 4,538,661 A | * | 9/1985 | Henry et al. | 160/189 X |
| 5,282,305 A | | 2/1994 | Nutt | 29/468 |
| 5,557,887 A | | 9/1996 | Fellows et al. | 49/28 |
| 5,698,073 A | | 12/1997 | Vincenzi | 160/188 |
| 6,253,824 B1 | * | 7/2001 | Mullet et al. | 160/188 |
| 6,326,751 B1 | * | 12/2001 | Mullet et al. | 318/434 |
| 6,401,792 B1 | * | 6/2002 | Mullet et al. | 160/188 |

FOREIGN PATENT DOCUMENTS

| | | | |
|---|---|---|---|
| EP | 0 485 294 | 5/1992 | E05F/15/16 |

* cited by examiner

*Primary Examiner*—David Purol
(74) *Attorney, Agent, or Firm*—Renner, Kenner, Greive, Bobak, Taylor & Weber

(57) ABSTRACT

A method of aligning a door operating system for operating an upwardly acting door including an operator that directly interrelates with a counterbalance assembly in the door operating system to move the door, where the operator is at least partially supported on the counterbalance assembly, loosely attaching the operator to a header adjacent the door, and, moving the door from a closed position to an open position and returning the door to the closed position to achieve alignment. Once aligned, the operator is securely attached to the header to maintain the system's alignment.

19 Claims, 6 Drawing Sheets

SECTIONAL DOOR OPERATOR ALIGNMENT METHOD

This application is a continuation in part of U.S. patent application Ser. No. 09/499,488, filed Feb. 7, 2000 now issued as U.S. Pat. No. 6,325,134 and further is a continuation in part of copending U.S. patent application Ser. No. 09/710,071 filed Nov. 10, 2000.

TECHNICAL FIELD

The present invention relates generally to a motorized operator for an upwardly acting door. More particularly, the present invention relates to a method of installing such an operator to reduce parasitic drag or binding produced by misalignment between the operator, counter balance system, and mounting bracket. More specifically, the present invention relates to a method of automatically relatively aligning the operator, the mounting bracket, the counterbalance system, and the door opening frame.

BACKGROUND OF THE INVENTION

In a motorized door operator system, an operator assembly is used to power a door from a closed position to an open position and vice versa. In one type of operator system, the motor has drive components that are coupled to driven components in a counterbalance system. When the drive components are misaligned relative to driven components, these components may bind or even lock up making it difficult to properly operate the door. In less serious instances, misalignment produces parasitic drag that saps operator power and imparts excessive wear to the operator components. To cope with this problem, manufacturers have provided an allowance for some misalignment in their door systems. Often the operator is connected to the counterbalance system by way of a flexible element, such as an endless belt or chain. Likewise, operator assemblies that are attached to a track system use flexible couplers to prevent parasitic loading or binding. The flexibility of these various couplers permits some misalignment between the drive components of the operator motor and the driven components of the counterbalance system. In other words, since the coupling between the operator and counterbalance assemblies is flexible a binding condition will not occur.

In one door operator system known in the industry, the operator is placed directly above the counterbalance system and mounted to the header. A drive shaft from the operator extends outside of the housing and carries a sprocket. A second sprocket is carried on the counterbalance shaft, and the two sprockets are coupled by a chain. In this way, if the operator is laterally misaligned or misaligned in a plane extending perpendicular to the door frame, the flexibility of the chain will allow for this misalignment and maintain a proper driving relationship between these components. If the lateral misalignment is severe, either sprocket may be slid along its respective shaft to regain proper alignment without having to move the operator. The use of the chain requires the operator be mounted some distance from the counterbalance system increasing the space necessary to mount the operator system. Further, the use of a flexible element, such as a chain, makes installation somewhat more involved. The installer must properly space the operator from the counterbalance system to ensure proper tensioning of the chain. Further, as previously mentioned, the sprockets on the operator shaft and counterbalance drive shaft must be aligned sufficiently that the operator may drive the counterbalance drive shaft without having the chain slip off of one of the sprockets.

Other door operating systems in the industry that directly drive the counterbalance drive shaft have the advantage of eliminating the space needed to tension the chain. One such system receives the counterbalance shaft within the operator housing and employs an operator having a worm gear that meshes with a gear on the counterbalance shaft to effect rotation thereof. In this system, the operator is placed immediately adjacent to the counterbalance system. While decreasing the space taken up by the operator system, this system gives up the simplicity of aligning the drive components to the driven components found in a flexible drive member system. Since there is direct interaction between the gears found on the operator assembly and the counterbalance assembly, there is little or no flexibility within the meshing of the gears to allow for parasitic drag or binding. Also, the drive tube is confined by the operator housing and, thus, cannot move to accommodate any significant extent of misalignment. Slight misalignment that could provoke binding or place a drag on the system may not be readily visible to the installer. Ordinarily, the installer is able to detect significant vertical misalignment of the operator or drive shaft with respect to each other. Since the cable drums, mounting hardware and other components make it difficult to view the system from its ends, misalignment in the plane perpendicular to the header is difficult to detect. Therefore, a misaligned operator may not be discovered until the door is operated, if at all. Consequently, based on the desirability of using such compact direct drive systems, there is a need for a simple method of aligning an operator assembly in such systems.

SUMMARY OF THE INVENTION

In light of the foregoing, an object of the present invention is providing a simple method of aligning a direct drive operator in a door operating system. A further object of the present invention is to provide such a method that automatically aligns an operator, an operator mounting bracket, and a counterbalance system in a door operating system. Still a further object of the present invention is to provide a method of aligning a direct drive operator in a door operating system where the door is manually cycled while the operator is loosely attached to align the operator and counterbalance system. Yet another object of the present invention is to provide such a method where the drive is disconnected before manually cycling the door. Still a further object of the present invention is to provide such a method where the door is moved from a closed position to an open position and returned to the closed position.

In view of at least one of these objects, the present invention generally provides a method of aligning an operator in a system for operating an upwardly acting door including providing an operator that directly interrelates with a counterbalance assembly in the door operating system to move the door, where the operator is at least partially supported on the counterbalance system, loosely attaching the operator to a header adjacent the door, and moving the door from a closed position to an open position and returning the door to the closed position to achieve alignment.

The present invention still further provides a method of aligning an operator in a door operating system for operating an upwardly acting door, where the operator fits on or around the drive tube of a counterbalance system including mounting the operator on a header adjacent the door; loosely attaching the operator to the header by fasteners, vertically moving the door, and subsequently tightening the fasteners to firmly attach the operator to said header.

The present invention further provides a method of aligning an operator and a counterbalance system relative to a fixed header including, mounting the counterbalance system on the header in operative relation to the door, positioning the operator in direct working interrelationship with the counterbalance system, loosely attaching the operator to the header by a mounting bracket, cycling the door from a closed position to an open position and returning the door to the closed position to permit self-alignment between the counterbalance system, operator and the header, and securely attaching the operator to the header after cycling the door.

PREFERRED EMBODIMENT FOR CARRYING OUT THE INVENTION

The method of the present invention is generally used with motorized door operators including operators that enclose a portion of the counterbalance system to operatively interrelate the motor and counterbalance assemblies including, for example, the operator disclosed in U.S. Pat. No. 5,931,212 issued Aug. 3, 1999, incorporated by reference herein. The method may also be used in connection with a door locking operator, generally depicted in FIG. 1, and, for example, may be of the type disclosed in U.S. patent application Ser. No. 09/710,071, filed Nov. 10, 2000, incorporated by reference herein. The ability to use the method with any of the above mentioned systems, or other similar systems, will become apparent as the description proceeds.

Figure 1:
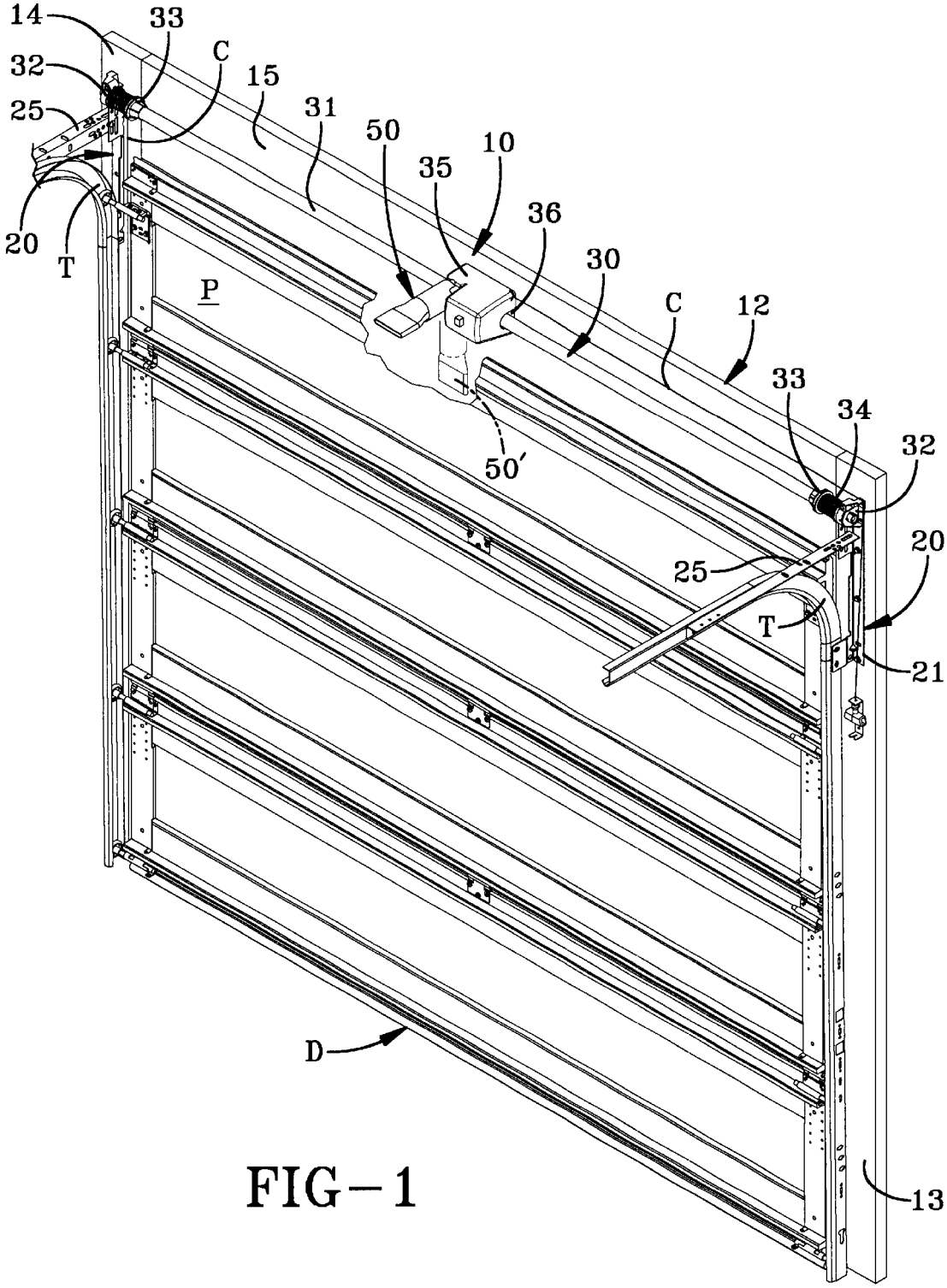
FIG. 1 is a rear perspective view of a sectional overhead garage door installation showing a motorized operator installed according to the method of the present invention.

A motorized operator system in accordance with above-mentioned U.S. patent application Ser. No. 09/548,191, filed Apr. 13,2000, incorporated by reference herein, is generally indicated by the numeral 10 in the drawing figures. The operator system 10 is mounted in conjunction with a sectional door D of a type commonly employed in garages for residential housing. The opening in which the door D is positioned for opening and closing movements relative thereto is defined by a frame, generally indicated by the numeral 12, which consists of a pair of spaced jambs 13, 14 that, as seen in FIG. 1, are generally parallel and extend vertically upwardly from the floor (not shown). The jambs 13, 14 are spaced and joined at their vertical upper extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the operator system 10.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg attached to an underlying jamb 13, 14 and a projecting leg preferably disposed substantially perpendicular to the leg attached to the jamb and, therefore, perpendicular to the jambs 13, 14.

Flag angles 20 also include an angle iron 25 positioned in supporting relation to tracks T, T located to either side of door D. The tracks T, T provide a guide system for rollers attached to the side of door D, as is well known to persons skilled in the art. The angle irons 25 normally extend substantially perpendicular to the jambs 13, 14 and may be attached to the transitional portion of tracks T, T between the vertical section and the horizontal section thereof or in the horizontal section of tracks T, T. The tracks T, T define the travel of the door D in moving upwardly from the closed position to the open position and downwardly from the open to closed position.

The operator system 10 may be electrically interconnected with a ceiling unit, which may contain a power supply, a light, a radio receiver with antenna for remote actuation of operator system 10 in a manner known in the art, and other operational peripherals. The ceiling unit may be electrically interconnected with a wall unit having an up/down button, a light control, and controls for other known functions.

Figure 2:
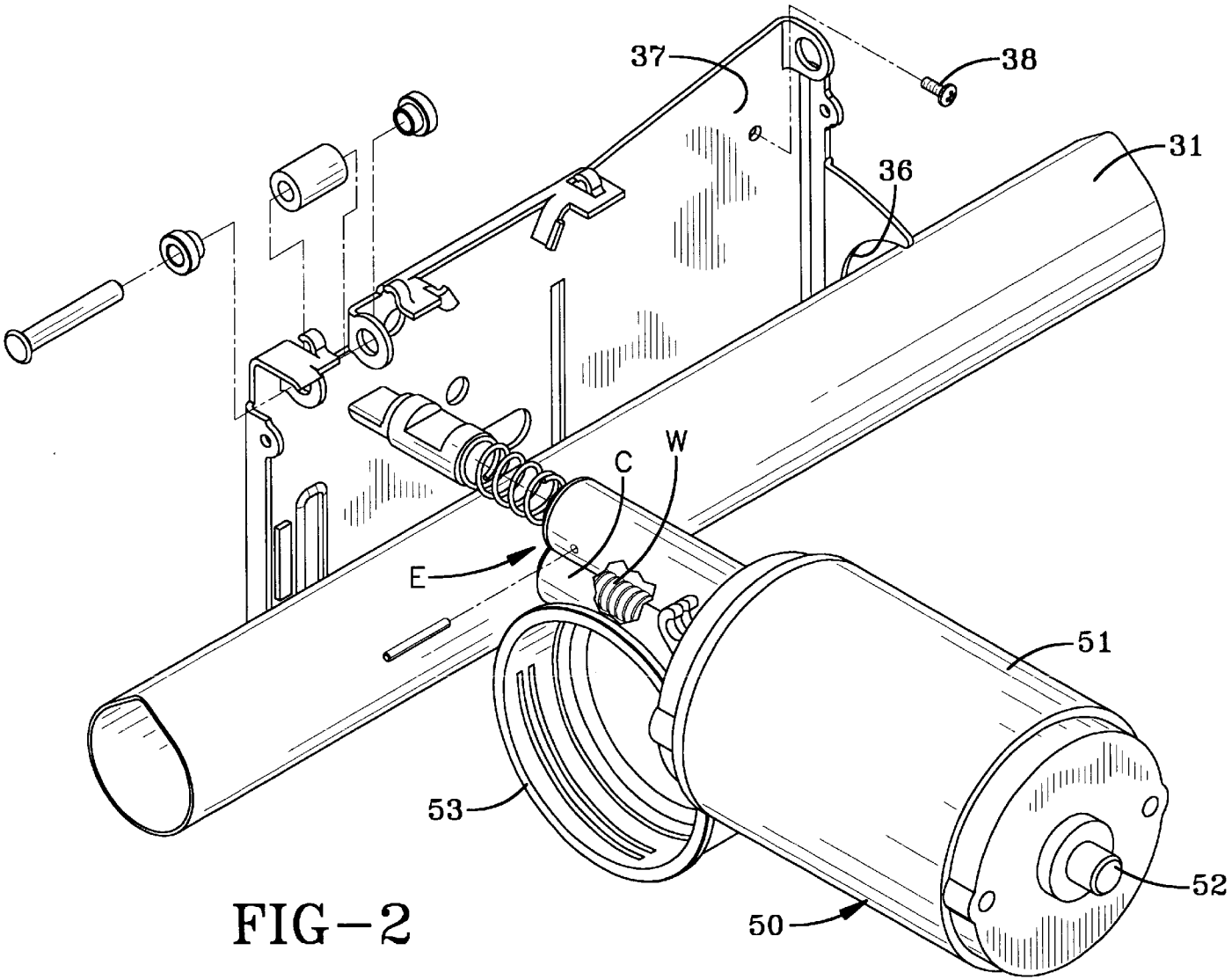
FIG. 2 is an enlarged perspective view of the motorized operator of FIG. 1 with the cover removed and portions broken away to show the mechanical interconnection of the motorized operator with the drive tube of the counterbalancing system.

Referring now to FIGS. 1 and 2 of the drawings, the operator system 10 mechanically interrelates with the door D through a counterbalance system, generally indicated by the numeral 30. As shown, the counterbalance system 30 includes an elongate drive tube 31 extending between tensioning assemblies 32, 32 positioned proximate each of the flag angles 20. While the exemplary counterbalance system 30 depicted herein is advantageously in accordance with U.S. Pat. No. 5,419,010, it will be appreciated by persons skilled in the art that operator system 10 could be employed with a variety of torsion-spring counterbalance systems. In any instance, the counterbalance system 30 includes cable drum mechanisms 33 positioned on the drive tube 31 proximate the ends thereof which rotate with drive tube 31. The cable drum mechanisms 33 each have a cable 34 reeved thereabout which is affixed to the door D preferably proximate the bottom, such that rotation of the cable drum mechanisms 33 operates to open or close the door D in conventional fashion.

As seen in FIGS. 1 and 2, the operator system 10 has an operator housing 35 which may conveniently enclose a length of the drive tube 31. While drive tube 31 is depicted as a hollow tubular member that is non-circular in cross-section, it is to be appreciated that circular drive tubes, solid shafts, and other types of driving elements that rotate cable drums, such as cable drum mechanisms 33, may be employed in conjunction with the operator system 10 of the instant invention and are encompassed within this terminology in the context of this specification.

Figure 3:
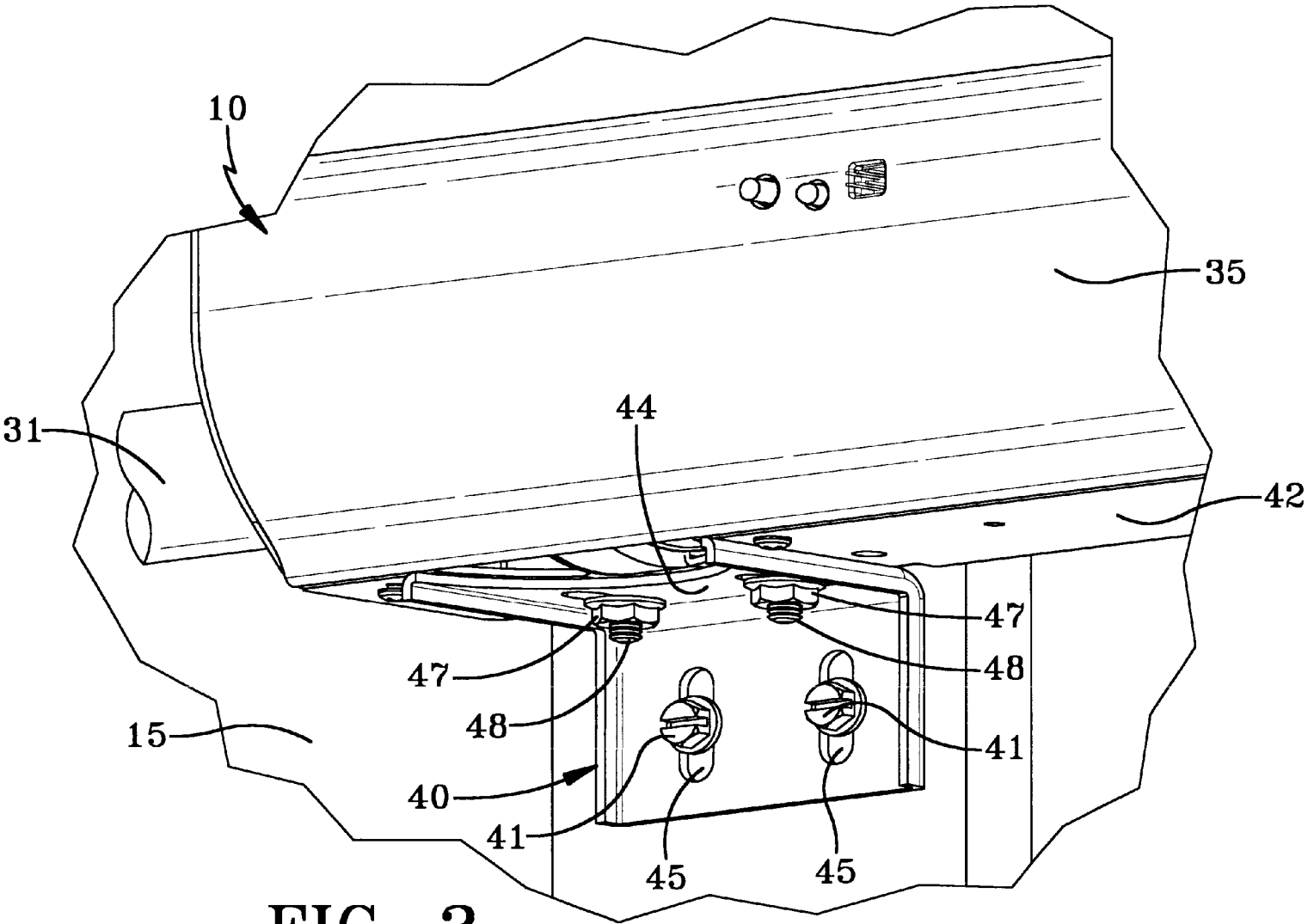
FIG. 3 is an enlarged perspective view of an alternative motorized operator and support bracket installed according to the concepts of the present invention.
Figure 4:
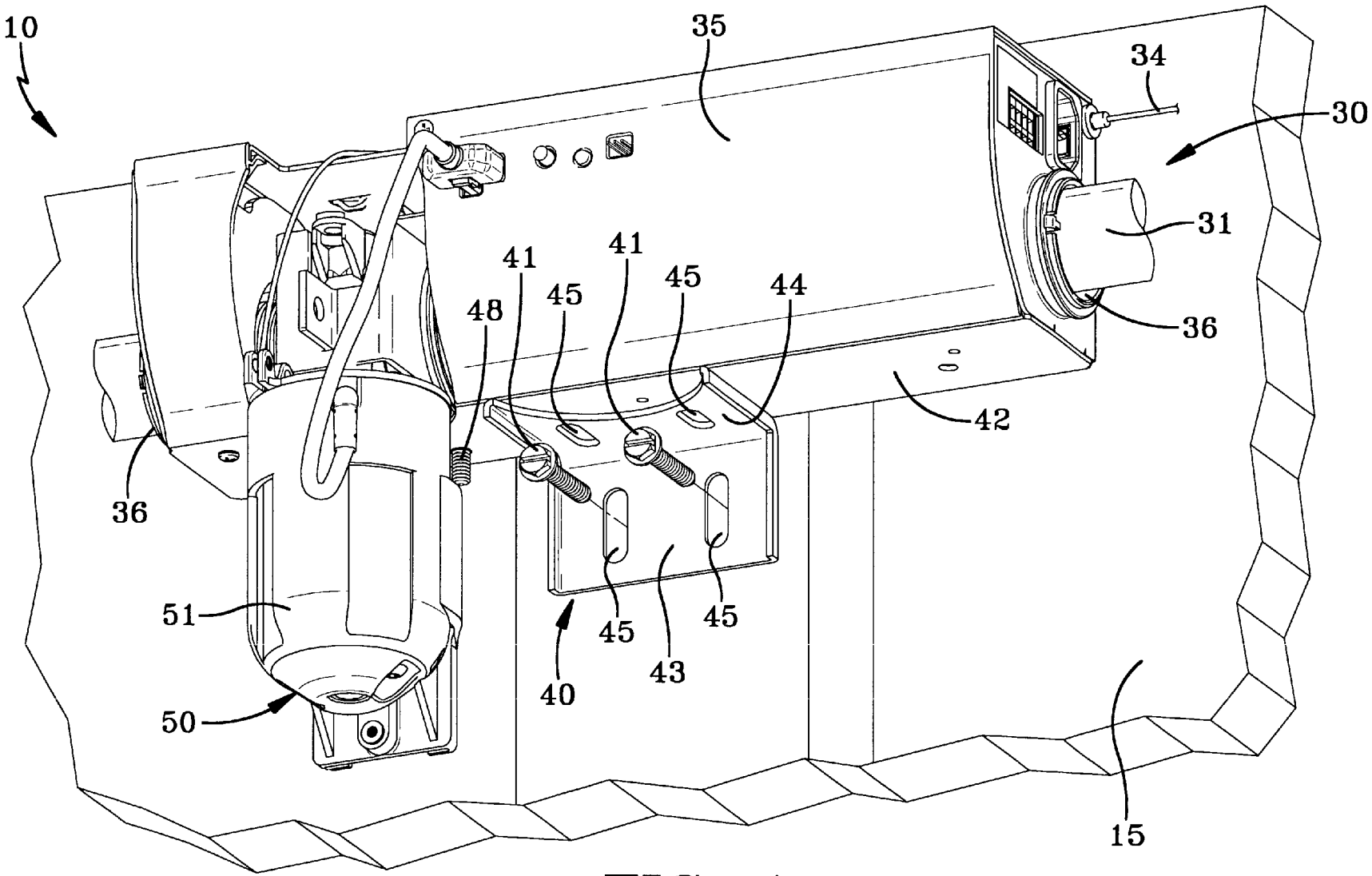
FIG. 4 is an enlarged perspective view similar to FIG. 3 depicting installation of the motorized operator according to the method of the present invention showing the attachment of mounting bracket to the header with motorized operator supported on a drive tube in a premounted position.

The operator housing 35 has apertures 36 at either end through which drive tube 31 extends. A mounting assembly, which may include a plate 37 that may be attached to the header 15 as by a plurality of cap screws 38 (FIG. 2), or an external mounting bracket 40 (FIG. 3) may be used to support operator housing 35 or more generally the operator system 10. The mounting bracket 40 may be attached to the header in any suitable manner including cap screws 41, as shown. The mounting bracket 40 may be placed in any suitable location including positions adjacent to one or more of the sides of operator housing 35, including a location beneath the bottom side 42 of the housing 35, as shown in FIG. 3. As seen in FIGS. 3 and 4, mounting bracket 40 is generally an angle iron having a header portion 43 that may be positioned to lie adjacent the header 15 and extends generally parallel thereto, and a housing portion 44 extending inwardly away from the door D at the vertical upper extremity of the header portion 43. Each portion 43, 44 is adapted to lie generally flush with the header 15 and housing surfaces 35 to which they attach and in the embodiment shown in FIG. 3, generally define a right angle between each other. Each portion 43, 44 may be provided with suitable receivers 45 for attaching the mounting bracket 40 to an underlying surface with cap screws 41 or the like. The operator housing 35 may be secured to the mounting bracket 40 by bolts 48 extending from the operator housing 35. As shown, a pair of bolts or studs 48 extend downwardly from the operator housing 35 to rest within receivers 45 located on the housing portion 44 and extend therethrough. A nut 47 may be used to secure the bolt 48. As will be described more completely below, during the installation process, the nuts 47 may be initially loosely attached to the bolts 48 to allow the operator housing 35 and mounting bracket 40 to be properly aligned before rigidly securing the operator housing 35 to the mounting bracket 40. In similar fashion, the cap screws 38, used to attach the operator housing 35 by way of the mounting plate 37, may be left slightly loose prior to alignment of the operator housing 35, motor assembly 50, and drive tube 31. Proper alignment of these elements to each other reduces the likelihood of binding and parasitic drag.

While operator housing 35 is shown mounted on drive tube 31 substantially medially between the cable drum mechanisms 33, 33, it is to be noted that with the depicted counterbalance system 30, the operator housing 35 could be mounted at any desired location along drive tube 31 should it be necessary or desirable to avoid an overhead or wall obstruction in a particular garage design. Operatively interrelated with the operator housing 35 is an operator motor assembly, generally indicated by the numeral 50. For purposes of powering the door D, the operator motor assembly 50 has an electric motor 51 constituting one of various types employed for overhead doors which is designed for stop, forward and reverse rotation of a motor shaft 52.

It will be appreciated that the drive components of the operator motor assembly 50 and the driven components of the door D may vary to an extent and, thus, the particular components used in the exemplary door operating system 10 to drive the door D are not to be considered limiting. A description of the components of one exemplary operator system is provided below by way of example only.

Figure 6:
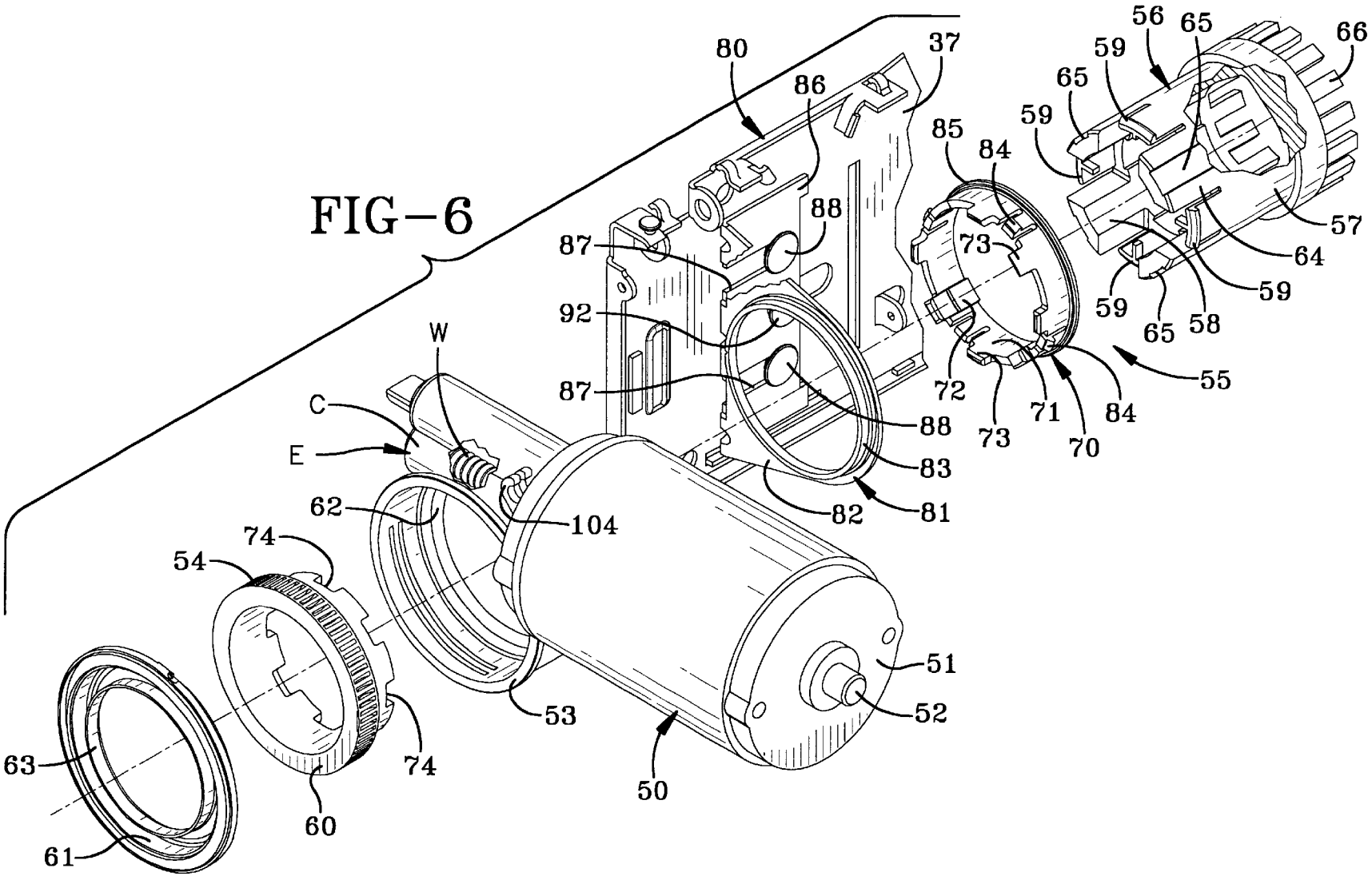
FIG. 6 is an exploded perspective view showing details of the drive system and the disconnect assembly of one motorized operator installed according to the method of the present invention.

In the system depicted in FIGS. 2 and 6, a drive train enclosure, generally indicated by the letter E, projects from the motor 51 toward the header 15. The drive train enclosure E has a hollow cylindrical extension portion C which extends from the motor cover. This cylindrical portion C of drive train enclosure E accommodates a worm W, which is attached to or may be cut into the shaft 52 of motor 51. The drive train enclosure E also includes an open-ended cylindrical journal 53 which intercommunicates through the wall thereof with the interior of the cylindrical portion C of drive train enclosure E and particularly with the worm W reposing therein. As best seen in FIGS. 2 and 6, the journal 53 seats internally thereof a worm wheel 54 which is at all times positioned in mating engagement with the worm W of the electric motor 51.

The drive tube 31 of counterbalance system 30 is selectively rotationally driven by motor 51 through a drive tube drive assembly, generally indicated by the numeral 55. The drive tube drive assembly 55 includes a slide guide, generally indicated by the numeral 56, which is a generally elongate, cylindrical member that has a substantially circular outer surface 57 that freely rotatably mounts the worm wheel 54 positioned within the drive train enclosure E. The slide guide 56 has internal surfaces 58 that are non-circular and, in cross-section, substantially match the out-of-round configuration of the drive tube 31. Thus, the slide guide 56 and drive tube 31 are non-rotatably interrelated, such that drive tube 31 moves rotationally with slide guide 56 at all times. The slide guide 56 is maintained at a fixed position axially of the drive tube 31 by interengagement with the drive train enclosure E and worm wheel 54. Proximate the axial extremity of the circular outer surface 57 of slide guide 56 are a plurality of spring catches 59. As shown, there are four spring catches 59 which are equally spaced about the outer periphery of the outer surface 57 of slide guide 56. When the slide guide 56 is positioned inside worm wheel 54, the spring catches 59 abut the axial surface 60 of the worm wheel 54.

The drive tube drive assembly 55 also includes an end cap 61 that interfits within the cylindrical journal 53 of the drive train enclosure E. Thus, the spring catches 59 of the slide guide 56 are interposed between and, thus, axially restrained by the axial surface 60 of worm wheel 54 and the end cap 61. Movement of the worm wheel 54 in an axial direction opposite the end cap 61 is precluded by a radial in-turned flange 62 in the cylindrical journal 53 of drive train enclosure 50. The end cap 61 has a radially inner rim 63 that serves as a bearing surface for the axial outer surface of circular outer surface 57 of slide guide 56 that extends axially beyond the spring catches 59.

The circular outer surface 57 of slide guide 56 has circumferentially-spaced, axial-extending grooves 65 for the purpose to be detailed hereinafter. The axial extremity of slide guide 56 opposite the axial outer surfaces 64 may be provided with encoder notches 66 generating encoder signals representative of door position and movement for door control system functions of a type known to persons skilled in the art.

Drive tube drive assembly 55 has a disconnect sleeve, generally indicated by the numeral 70, which is non-rotatably mounted on, but slidable axially of, the slide guide 56. As best seen in FIG. 6, the disconnect sleeve 70 has a generally cylindrical inner surface 71 that is adapted to slidingly engage the circular outer surface 57 of slide guide 56. The inner surface 71 has one or more tabs 72 that are inwardly raised, axially-extending surfaces, which are adapted to matingly engage the axially-extending groove 65 of slide guide 56. Thus, when disconnect sleeve 70 is mounted on slide guide 56, with tabs 72 engaging the groove 65, the disconnect sleeve 70 is free to slide axially of the slide guide 56, but is precluded from relative rotation. The axial extremity of disconnect sleeve 70, which faces the worm wheel 54 has a plurality of circumferentially-spaced, projecting teeth 73. The teeth 73 selectively engage and disengage base circumferential recesses 74 in the axial extremity of worm wheel 54 opposite the axial surface 60.

The selective engagement and disengagement of the disconnect sleeve 70 with the worm wheel 54 is controlled by a disconnect actuator, generally indicated by the numeral 80. The disconnect actuator 80 has a disconnect bracket, generally indicated by the numeral 81. Disconnect bracket 81 is generally L-shaped, with a triangular projection 82 that has a ring-shaped receiver 83 that seats disconnect sleeve 70. The disconnect sleeve 70 has circumferentially-spaced, radially-outwardly extending catches 84 that 10 engage one axial side of ring-shaped receiver 83. The disconnect sleeve 70 also has a flange 85 at the axial extremity opposite teeth 73 and catches 84, such as to maintain disconnect sleeve 73 axially affixed to receiver 83, but freely rotatable relative thereto.

The disconnect bracket 81 has a right angle arm 86 relative to the triangular projection 82, which is removably affixed to the mounting plate 37 of operator housing 35. As previously described, a mounting bracket may replace or be used in conjunction with mounting plate 37 to support the housing 35 on header 15. The arm 86 has a pair of spaced lateral slots 87 through which headed lugs 88 project to support the disconnect bracket 81 and limit its motion to an axial direction, whereby the disconnect bracket 81 moves the disconnect sleeve 70 directly axially into and out of engagement with the worm wheel 54.

During installation of the door operating assembly 10, the components of the door operating system 10 are aligned, according to the method to follow, to reduce parasitic drag and binding. In general, alignment is achieved by loosely fastening the operator housing 35 to the header 15 and moving the door D up and down. During this movement, the components of the operator system 10 move to a bindless position. Referring to the operator system 10 depicted in FIG. 1, the operator housing 35 may mount on drive tube 31 such that it may be slid along the length of drive tube 31 to a desired location. With the operator housing 35 on the drive tube 31 and level with the top of the door D, the mounting bracket 40, may be positioned at the desired location and firmly attached to the header 15 by cap screws 41. It may be advantageous, when using a door locking operator 10 (FIG. 4) to attach the mounting bracket 40 to the header 15, to initially locate the operator housing 35 slightly displaced from its ultimate position (premounted position FIG. 4) to prevent the pivoting motor assembly 50 from blocking the bracket 40 or otherwise interfering with attachment of the mounting bracket 40 to the header 15.

Once the mounting bracket 40 is attached, the operator housing 35 may be adjusted such that the bolts 48 fall into receivers 45 on housing portion 44 of the bracket 40. At this point, nuts 47 or similar fasteners are placed on the bolts 48 and left loose, as depicted by the chain line position of nuts 47' in FIG. 5. In that regard, the nuts 47 may be started onto the bolts 48, positioned intermediately of the ends of bolts 48 and housing portion 44 of mounting bracket 40, or finger-tightened against mounting bracket 40. With the nuts 47 loose, the operator drive may be disconnected and the door D manually moved from the closed to the open position and returned to the closed position with the nuts 47, attaching the housing 35 to bracket 40, loose, whereby the operator 10 and drive tube 31 are free to move perpendicularly to the header 15.

During this movement of the door D, the drive tube 31 may rotate from 28 to 32 revolutions allowing the operator 10 and drive tube 31 to move into a substantially bind-less position. Movement of the drive tube 31 and operator components allows the components, which may have entered a bound condition during assembly, to self adjust relative to each other and move into a substantially bind-less position throughout the operating sequence. In this position, alignment of the door opening 11, counterbalance system 30, mounting bracket 40 and motor assembly 50 is achieved reducing parasitic drag and, as mentioned, preventing a binding condition. Since the operator housing 35 is only loosely attached to the header 15, by way of mounting bracket 40, there is sufficient play within the system to allow the components to move into the properly aligned positions.

Figure 5:
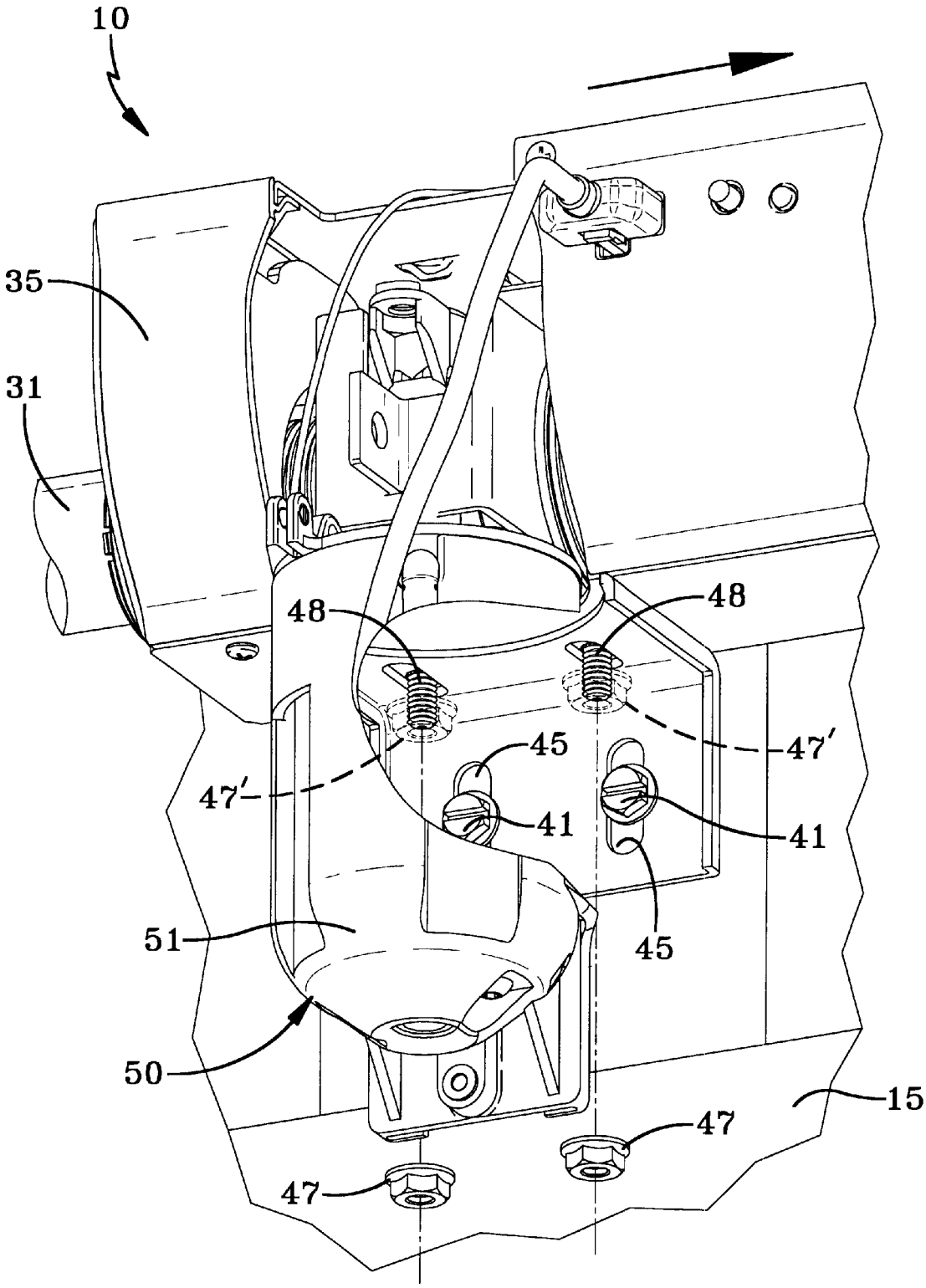
FIG. 5 is an enlarged perspective view of a motorized operator installed in accordance with the concepts of the present invention depicting the operator loosely attached to a mounting bracket by nuts shown in chain lines.

After the components have been aligned, the system 10 is tightened to secure the alignment, as by tightening nuts 47 to a secure position shown in solid lines in FIGS. 3 and 5. At this point, any additional steps in the installation of the door operator may be completed and the properly aligned door is ready for operation.

It will be appreciated that it may also be advantageous to leave the fasteners 41 connecting the bracket 40 to the header 15 loose to allow vertical self-adjustment, as well. In such instance the nuts 47 and fasteners 41 are tightened subsequent to manually moving the door D from the closed to the open position and back to the closed position. Alternatively, the door D may first be manually cycled with the fasteners 41 tightened and the nuts 47 loose and then manually cycled with the nuts 47 tightened and the fasteners 41 loose, or vice versa.

Thus, it should be evident that a sectional door operator method disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention being limited solely by the scope of the attached claims.

I claim:

1. A method of aligning an operator in a system for operating an upwardly acting door comprising:

providing an operator that directly interrelates with a counterbalance assembly in the door operating system to move the door, where the operator is at least partially supported on the counterbalance assembly;

loosely attaching the operator to a header adjacent the door; and moving the door from a closed position to an open position and returning the door to the closed position to achieve alignment.

2. The method of claim 1 further comprising, securely attaching the operator to the header after moving the door from a closed position to the open position and returning the door to the closed position.

3. The method of claim 2 further comprising, providing a mounting bracket to attach the operator to the header, the mounting bracket being attached to the header by header fasteners and the operator being attached to the mounting bracket by operator fasteners.

4. The method of claim 3, wherein the header fasteners are tightened and the operator fasteners are left loose prior to the step of moving the door.

5. The method of claim 3, wherein the operator fasteners are tightened and the header fasteners are left loose prior to the step of moving the door.

6. The method of claim 3, wherein both the header fasteners and the operator fasteners are left loose during the moving of the door.

7. The method of claim 3, wherein one of the operator fasteners and header fasteners is left loose during a first moving of the door and wherein the other of the operator fasteners and the header fasteners is left loose during a second moving of the door.

8. A method of aligning a door operating system having a counterbalance assembly and an operator for operating an upwardly acting door, where the operator fits on or around the counterbalance system, comprising:

mounting the operator on a header adjacent the door;

loosely attaching the operator to the header by fasteners;

vertically moving the door; and subsequently tightening the fasteners to firmly attach the operator to said header.

9. The method of claim 8 further comprising, slidably mounting the operator on the drive tube prior to mounting the operator to the header;

attaching a mounting bracket in a selected position on the header;

sliding the operator such that fasteners on said operator are received by the mounting bracket; and loosely attaching the operator to the header by partially securing the operator to the mounting bracket with said fasteners.

10. The method of claim 9, wherein attaching a mounting bracket includes placing the mounting brackets subjacent the bracket and aligned with the operator prior to fastening the mounting bracket to the header.

11. The method of claim 8, wherein vertically moving the door includes moving the door from a closed position to an opened position and returning the door to the closed position.

12. The method of claim 8 further comprising, disconnecting the operator prior to vertically moving the door.

13. A method of mounting an operator for an upwardly acting door to a header such that it is automatically aligned relative to a counterbalance system and mounting assembly comprising:

attaching the mounting assembly to the header, said mounting assembly including a mounting bracket adapted to support said operator, wherein a pair of threaded bolts extend from the operator into receivers formed on said mounting bracket;

placing nuts on said bolts and leaving said nuts loose such that said mounting bracket and the operator are free to move relative to each other;

moving the door from a closed position to an opened position and returning the door to the closed position; and tightening said nuts to secure the operator to said mounting bracket.

14. In an operating system for an upwardly acting sectional door a method of aligning an operator and a counterbalance system relative to a fixed header comprising the steps of:

mounting the counterbalance system on the header in operative relation to the door;

positioning the operator in direct working interrelationship with the counterbalance system;

loosely attaching the operator to the header by a mounting bracket;

cycling the door from a closed position to an open position and returning the door to the closed position to permit self-alignment between the counterbalance system, operator and the header; and securely attaching the operator to the header after cycling the door.

15. The method of claim 14 further comprising the steps of:

providing header fasteners to attach the mounting bracket to the header; and providing operator fasteners to attach the mounting bracket to the operator.

16. The method of claim 15 further comprising the steps of:

tightening the header fasteners and loosening the operator fasteners prior to the step of cycling the door.

17. The method of claim 15 further comprising the step of:

tightening the operator fasteners and loosening the header fasteners prior to the step of cycling the door.

18. The method of claim 15 further comprising the step of:

loosening both the header fasteners and the operator fasteners prior to the step of cycling the door.

19. The method of claim 15 further comprising the steps of:

loosening one of the operator fasteners and header fasteners prior to a first cycling of the door; and loosening the other of the operator fasteners and header fasteners prior to a second cycling of the door.

* * * * *